US008109320B2

(12) United States Patent
Kawa et al.

(10) Patent No.: US 8,109,320 B2
(45) Date of Patent: Feb. 7, 2012

(54) METHOD AND APPARATUS FOR THE CONTINUOUS CASTING OF PRELIMINARY STEEL SECTIONS

(75) Inventors: Franz Kawa, Adilswil (CH); Paul Mueller, Greppen (CH)

(73) Assignee: Concast AG, Zurich (CH)

( * ) Notice: Subject to any disclaimer, the term of this patent is extended or adjusted under 35 U.S.C. 154(b) by 196 days.

(21) Appl. No.: 12/140,135

(22) Filed: Jun. 16, 2008

(65) Prior Publication Data

US 2008/0251231 A1 Oct. 16, 2008

Related U.S. Application Data

(63) Continuation of application No. PCT/EP2006/011972, filed on Dec. 13, 2006.

(30) Foreign Application Priority Data

Dec. 24, 2005 (EP) ..... 05028469

(51) Int. Cl.
*B22D 11/00* (2006.01)

(52) U.S. Cl. ..... 164/468; 164/499

(58) Field of Classification Search ..... 164/467, 164/468, 498, 499, 504, 418
See application file for complete search history.

(56) References Cited

U.S. PATENT DOCUMENTS 3,911,997 A * 10/1975 Sugazawa et al. ..... 164/504
4,867,786 A 9/1989 Saeki et al.
2003/0183363 A1 10/2003 Lehman et al.
2004/0194907 A1* 10/2004 Grober et al. ..... 164/476
2005/0167073 A1* 8/2005 Hong ..... 164/113

FOREIGN PATENT DOCUMENTS

| | | | |
|---|---|---|---|
| EP | 1419021 A | | 5/2004 |
| JP | 58224050 A | * | 12/1983 |
| JP | 62207543 A | * | 9/1987 |
| JP | 8294746 A | | 11/1996 |
| JP | 10230349 A | | 9/1998 |
| JP | 2005066613 A | | 3/2005 |

OTHER PUBLICATIONS

Machine Translation of JP 08-294746.*

* cited by examiner

*Primary Examiner* — Jessica L Ward
*Assistant Examiner* — Steven Ha
(74) *Attorney, Agent, or Firm* — Brian Roffe

(57) ABSTRACT

In a method and apparatus for the continuous casting of preliminary steel sections, the liquid or molten steel is introduced substantially vertically into an open-ended die. The cross section of the cavity of the die is made up of a web part and one or more flange parts, for example, such as in preliminary double-T sections. The liquid core of the strand of the preliminary section is set in agitating motions transversely to the direction of continuous casting by selectively using electromagnetically-induced forces in the regions of the flange parts and/or of the web part. The agitating motions have the effect of exchanging the liquid steel in the molten crater of the strand of the preliminary section in and between flange parts and the web part. This allows the flow and temperature conditions in the liquid steel crater within the strand of the preliminary section to be actively influenced in a targeted manner and stabilization of the region of the surface of the liquid metal to be brought about, along with favorable and controllable flow conditions.

18 Claims, 8 Drawing Sheets

METHOD AND APPARATUS FOR THE CONTINUOUS CASTING OF PRELIMINARY STEEL SECTIONS

This application is a continuation of PCT Application No. PCT/EP06/011972, filed Dec. 13, 2006, which claims the benefit of European Application No. 05028469.4 filed Dec. 24, 2005, the entirety of which are incorporated by reference herein.

BACKGROUND OF THE INVENTION

1. Field of the Invention

The invention relates to continuous casting of preliminary steel sections, such as, for example, preliminary I-sections.

2. Description of Related Art

Preliminary steel sections represent primary material for producing rolled sectional steel beams of I, H, U and Z cross-sectional shape as well as special sheet pile sections. A method for the continuous casting of preliminary sections of this kind is disclosed, for example, in EP-B-1 419 021. The continuous casting of preliminary sections was introduced on an industrial scale in the seventies and has been increasingly gaining in importance in recent years in consequence of the general trend towards so-called near net shape casting.

The preliminary sections are in most cases cast in an I-cross-sectional shape, the molten steel being introduced substantially vertically into a so-called "dog-bone" continuous mold whose mold cavity cross-section is composed of two flange parts and a web part. A preliminary sectional strand with a molten core is fed from the mold to a strand guide with secondary cooling devices.

Unlike the continuous casting of conventional long products of a rectangular or round cross section, the continuous casting of preliminary I-sections represents several problems, in particular in the case of preliminary sections with a relatively thin web part, when high strength special steel grades (CaSi or Al-killed and microalloyed steels with V, Nb, inter alia) are cast, or in the case of high-speed casting. For reasons of space, although also governed by economics, the molten steel is only introduced into the mold via one ingate, in most cases asymmetrically at the transition between the web part and one of the flange parts. It is consequently particularly difficult to fill the complicated mold cavity uniformly and without disturbing turbulence and thus create favorable conditions for the initial solidification while preventing near-surface casting defects (gas bubbles, pin holes). It is also difficult to obtain a symmetrical liquid flow inside the strand shell and consequently a symmetrical temperature distribution, which ultimately results in a homogeneous solidification structure. It is equally problematic, where a thin web part is concerned, to prevent arching during solidification and resultant core porosity and/or shrink holes.

A continuous mold for the continuous casting of preliminary I-sectional strands is known from JP 08 294746 A. Molten steel is introduced into the two flange parts via 2 submerged nozzles. In order to prevent surface defects on the preliminary sectional strand, it is proposed that a pair of static magnetic poles with S or N poles be disposed outside of the mold cavity both on the two flange outer sides and on both sides of the web part. Through the static magnetic field just below the mouth of the two submerged nozzles, the steel jet emerging from the submerged nozzles is to be slowed down and flow back in a horizontal flow to the mold wall and along this to the liquid surface. The static magnetic fields with N and S poles gives rise to a slowing-down effect of the vertical discharge flow from the submerged nozzles and an uncontrolled deflection from the vertical flow. This prior art does not refer to controlled, reversible traveling fields or flows in the molten crater for creating controlled flow and temperature conditions in the crater of the preliminary sectional strand.

SUMMARY OF THE INVENTION

The object of the present invention is to provide a method and apparatus by which preliminary steel sections, for example comprising two flange parts and a web part, can be produced with an improved quality, even if the preliminary section comprises a relatively thin web part and/or special steel grades are to be cast. A further aim, depending on the dimensions or the steel quality of the preliminary sectional strand, is to enable a symmetrical or an asymmetrical steel feed with one or with two open or closed ingates into the mold to be selected.

According to the invention, electromagnetically induced forces in the region of the flange parts and/or of the web part causes stirring movements in the molten core of the preliminary sectional strand transversely to the strand casting direction. Due to such stirring movements, the molten steel in the crater of the preliminary sectional strand is exchanged between flange parts and the web part. Thus, the flow and temperature conditions in the molten steel crater within the preliminary sectional strand shell are specifically and actively influenced. The invention produces the following beneficial and previously unobtained effects:

- stabilization of the metal surface region by suppressing turbulence, even in the case of varying process parameters, such as, for example, casting speed and metal surface position (for the purpose of preventing non-metallic inclusions as well as gas bubbles in the strand surface);
- favorable, controllable flow conditions with a specifiable molten steel exchange between relatively thicker thickened cavity regions through a thinner web part, even in the case of an asymmetrical ingate, and thereby the formation of a uniformly thick strand shell with a favorable solidification structure, while preventing shrink holes and/or core porosity.
- prevention of arching during solidification in spite of confined conditions in the web part of the mold cavity cross section.

In addition, different traveling field combinations in the flange parts and/or in the web part can be selected in the case of varying steel qualities or different dimensions of the preliminary sectional strand with the same stirrer. It is likewise possible to set traveling fields with completely different direction components in different locations, e.g., the flange parts and/or in the web part if the pouring system is changed, without making any structural changes to the stirrer.

DESCRIPTION OF THE DRAWINGS

The foregoing and other features of the present invention will be more readily apparent from the following detailed description and drawings of illustrative embodiments of the invention where like reference numbers refer to similar elements throughout and in which.

DESCRIPTION OF EMBODIMENTS OF THE INVENTION

Figure 1:
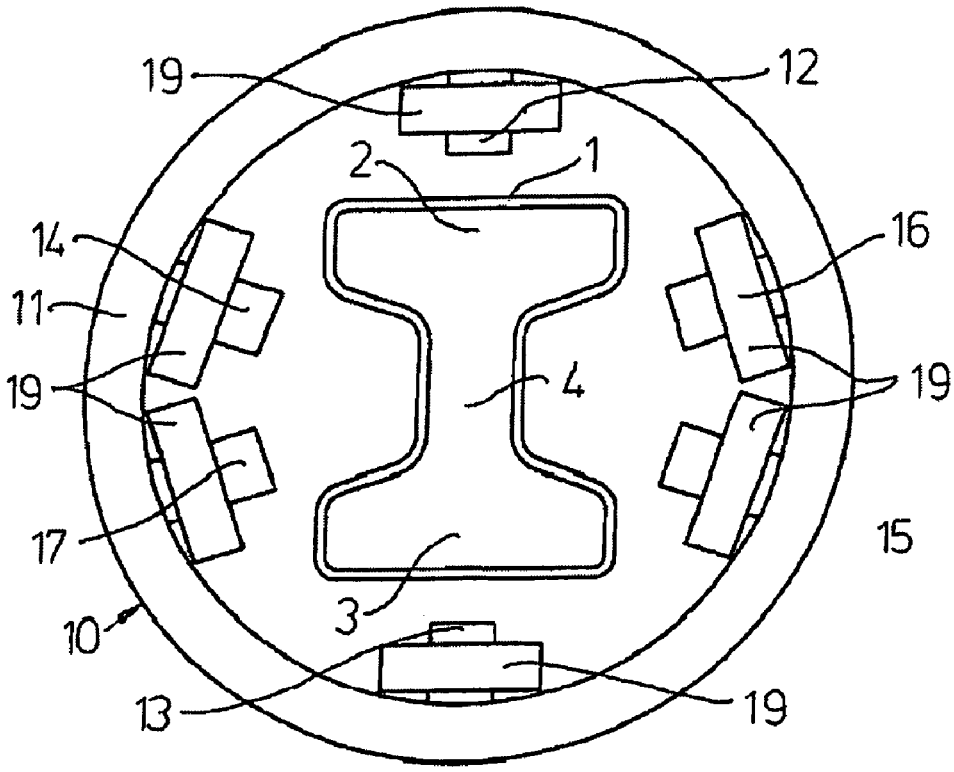
FIG. 1 shows a cross section of a mold in accordance with embodiments of the invention.

FIG. 1 shows in schematic form a mold 1 (in horizontal mold cavity cross section) that is composed of two flange parts 2, 3 and a web part 4. The mold 1 is suitable, as is known in the art, for the continuous casting of preliminary sections, in this example, I-sections. Molten steel is introduced substantially vertically into this continuous mold, in which a strand crust forms and from which a preliminary sectional strand with a molten core is fed to a strand guide with secondary cooling devices.

An electromagnetic stirrer 10 uses three-phase current to produce electromagnetically induced forces, preferably in the region of the mold 1 or directly at the exit from the mold 1, causing stirring movements in the molten core of the preliminary sectional strand generally transversely to the strand casting direction. As a result, molten steel in the crater of the preliminary sectional strand is thereby exchanged between the flange parts 2, 3 and the web part 4.

The stirrer 10 which is represented in FIG. 1 comprises an annular closed yoke 11, which surrounds the mold 1 at a certain vertical position. Six magnetic poles in the form of pole shoes 12 to 17, each pole being surrounded by an electromagnetic coil 19. The pole shoes 12 to 17 are non-uniformly distributed at the circumference of the yoke 11 such that each pole shoe 12, 13 is oriented towards the flange parts 2, 3 and each two pole shoes 14, 15; 16, 17 are oriented from both sides towards the web part 4. The stirrer 10, or in this example the rotating stirrer, works according to the principle of a 6-pole asynchronous motor, in the case of which a traveling field can be generated by means of three-phase current. In this respect, the poles must be correctly interconnected in order to generate a linearly traveling or rotating field or linear or rotating flows.

Figure 2:
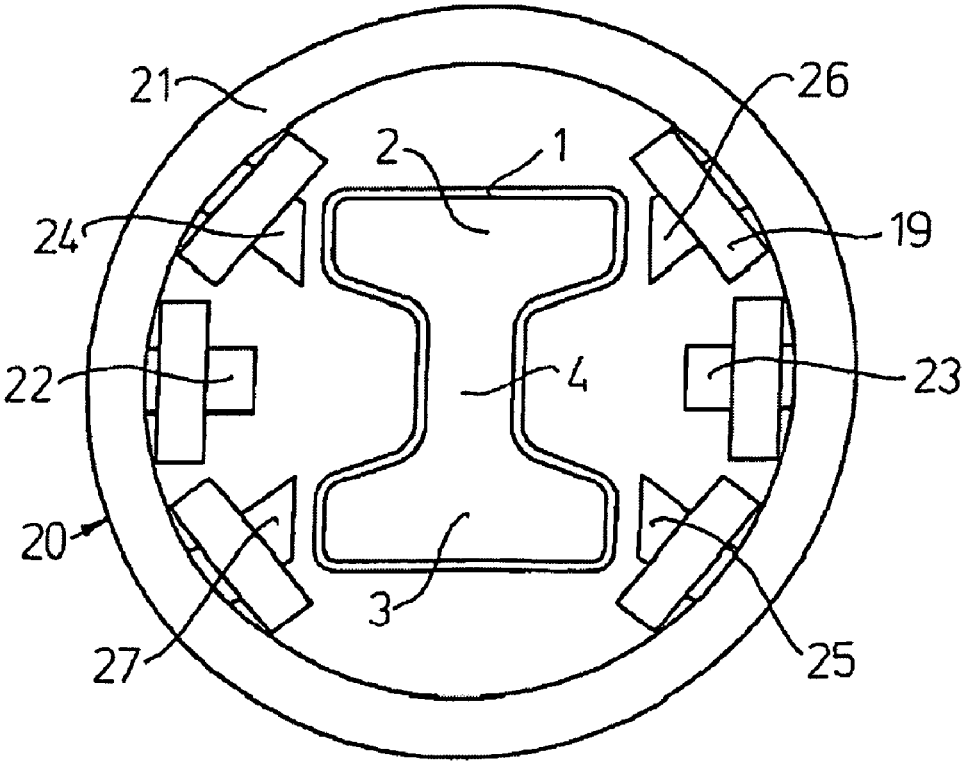
FIG. 2 shows a cross section of a mold in accordance with additional embodiments of the invention.

In an embodiment shown in FIG. 2, the mold 1 is again surrounded in a certain and preferably adjustable vertical position by an electromagnetic stirrer 20 with an annular, closed yoke 21, at the circumference of which six pole shoes 22 to 27 are again non-uniformly distributed, with the difference that all six pole shoes 22 to 27 are oriented substantially for linear flows in the web part 4.

According to FIGS. 3 to 6, an electromagnetic stirrer 30 is in each case associated with the mold 1, which stirrer comprises a closed yoke 31 which surrounds the mold 1, is formed as a rectangular frame, with the longitudinal sides of which three respective pole shoes 34, 35, 36 and 37, 38, 39, distributed over the mold width, are associated, and the narrow sides of which are provided with a respective central pole shoe 32, 33 oriented frontally towards the flange parts 2, 3. As is described herein, the stirrer 30 can be operated both as a rotating stirrer and as a linear stirrer, depending on the pole interconnection, i.e., according to which pole shoes are to be energized and with which phase sequence (cf. the phase designation U, V, W; U', V', W'). Four different operating possibilities, in which six of the total of eight pole shoes 32 to 39 are in each case organized, are presented on the basis of FIGS. 3 to 6.

Figure 3:
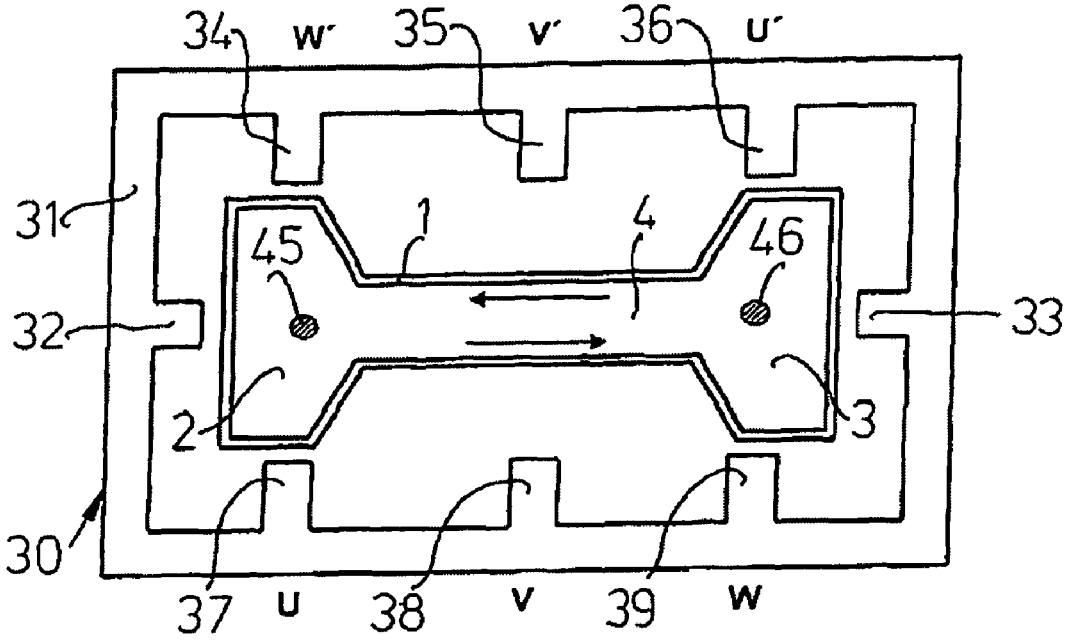
FIGS. 3-6 shows a cross section of a mold in accordance with further embodiments of the invention with different pole shoe connections.

As an example, with respect to FIG. 3, pole shoes 32, 33 may be disconnected and the pole shoes 34, 35, 36 on one longitudinal side of the yoke 31 may be phase-shifted with respect to the pole shoes 37, 38, 39 on the other longitudinal side, resulting in a linear flow in opposite directions in the web part 4 (2×3-pole linear operation, in opposite directions). This pole interconnection is preferable in the case of symmetrically disposed ingates 45, 46 in the flange parts 2, 3.

Figure 4:
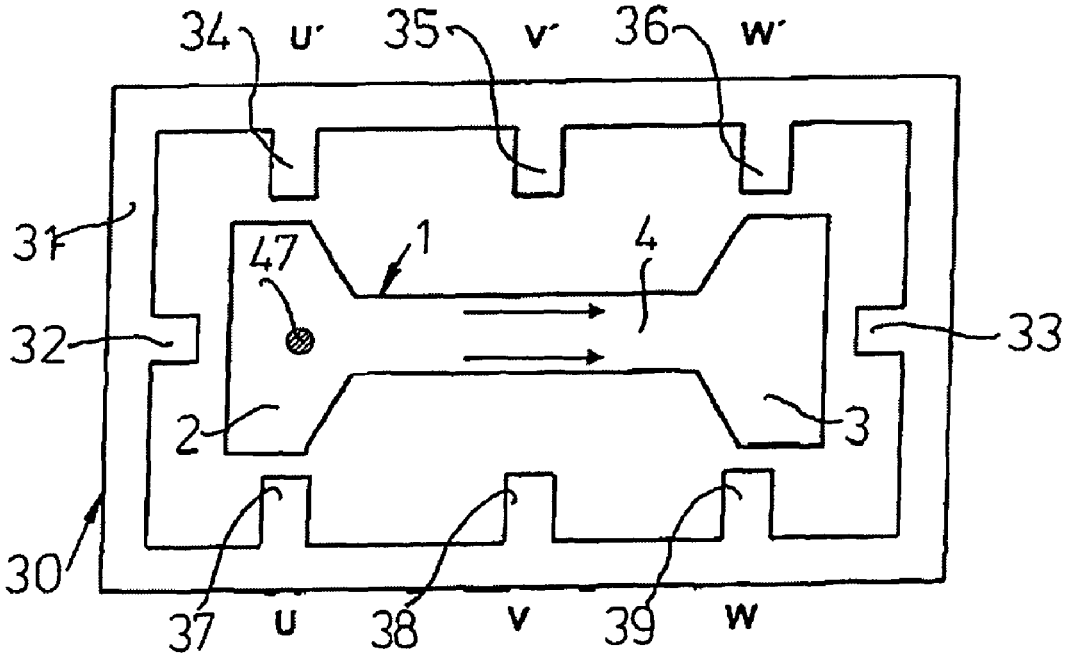

Another example, shown with respect to FIG. 4, comprises a pole interconnection for a linear operation (central pole shoes 32, 33 in the flange region disconnected), with phase sequence U, V, W on both longitudinal sides, resulting in a flow in the same direction in the web part 4 (2×3-pole linear operation, in the same direction). This pole interconnection is preferable in the case of an asymmetrically disposed ingate 47 in the flange part 2 or 3.

Figure 5:
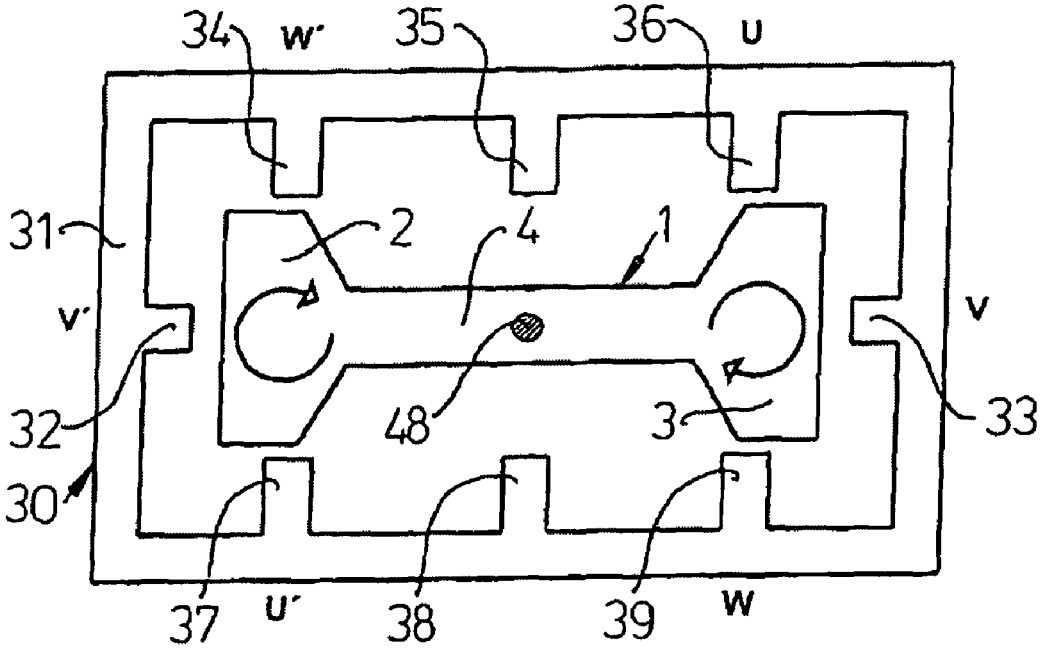

In another example, shown in FIG. 5, central pole shoes 32, 33 in the flange region are energized, but the central of the three pole shoes 34, 35, 36; 37, 38, 39, which are associated with the two longitudinal sides, are disconnected (pole shoes 35, 38 de-energized). Rotating fields are therefore generated in the flange regions (2×3-pole rotating operation). With phase assignment to the pole shoes 37, 32, 34 and 36, 33, 39, the direction of rotation of the rotating fields in the two flange parts 2, 3 is the same, which also results in a flow in the web part 4, although this is less efficient than in the case of the linear operation according to FIG. 3. This pole interconnection is preferable in the case of a symmetrically disposed ingate 48 in the web part 4.

Figure 6:
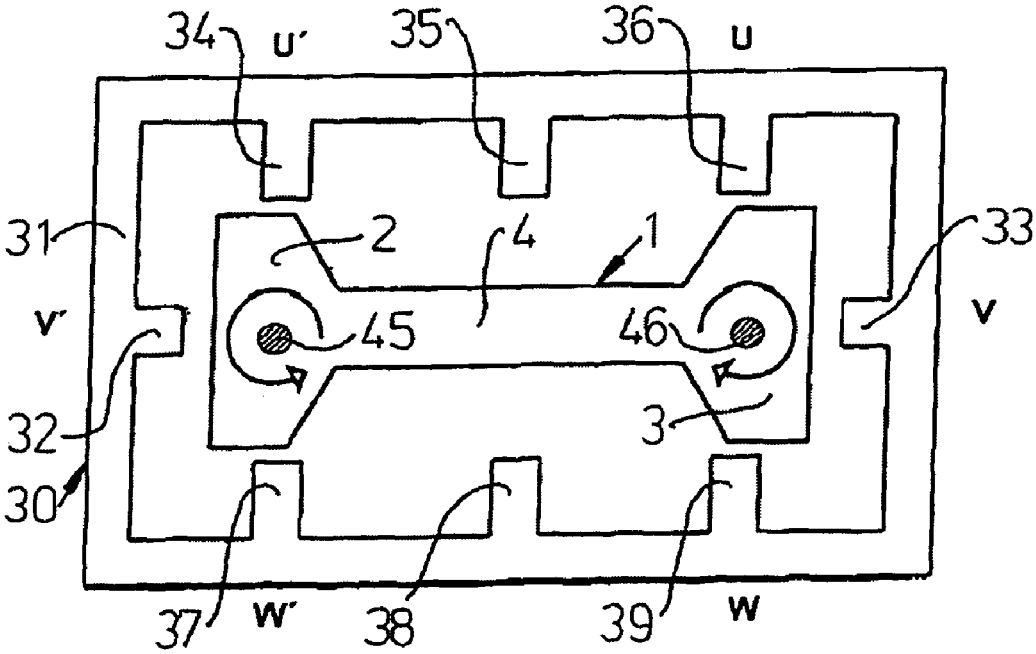

Turning to the example shown in FIG. 6, an interconnection of the pole shoes 37, 32, 34 and 36, 33, 39 can generate rotating fields with opposite directions of rotation in the flange parts 2, 3 by the stirrer 30. This pole interconnection is preferable in the case of two symmetrically disposed ingates 45, 46 in the flange parts 2, 3.

Figure 7:
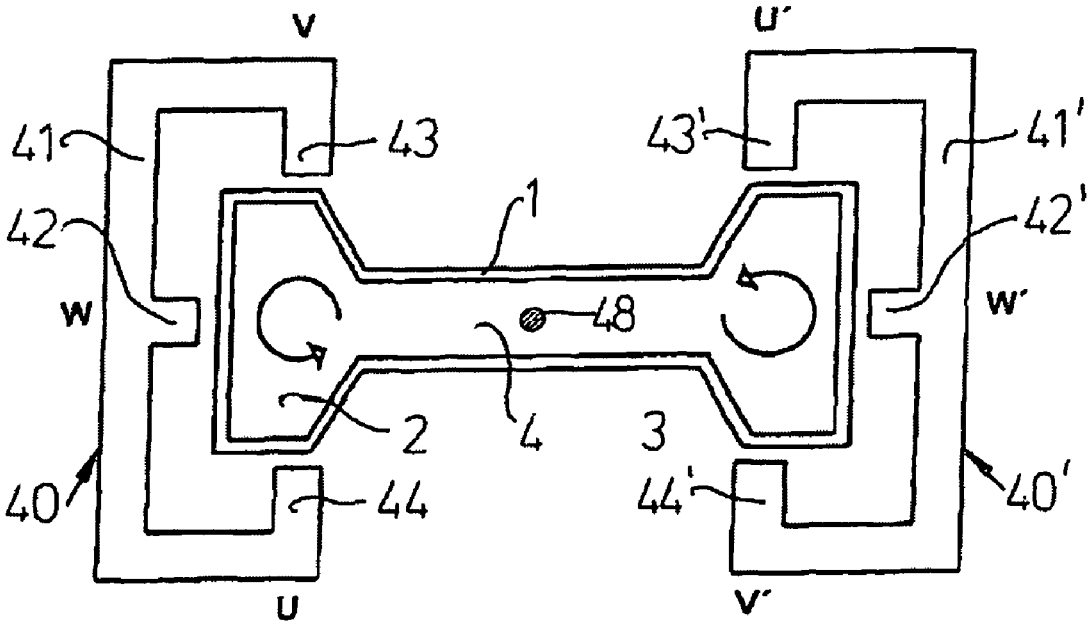
FIGS. 7-8 shows a cross section of a mold in accordance with more embodiments of the invention with different pole shoe connections.
Figure 8:
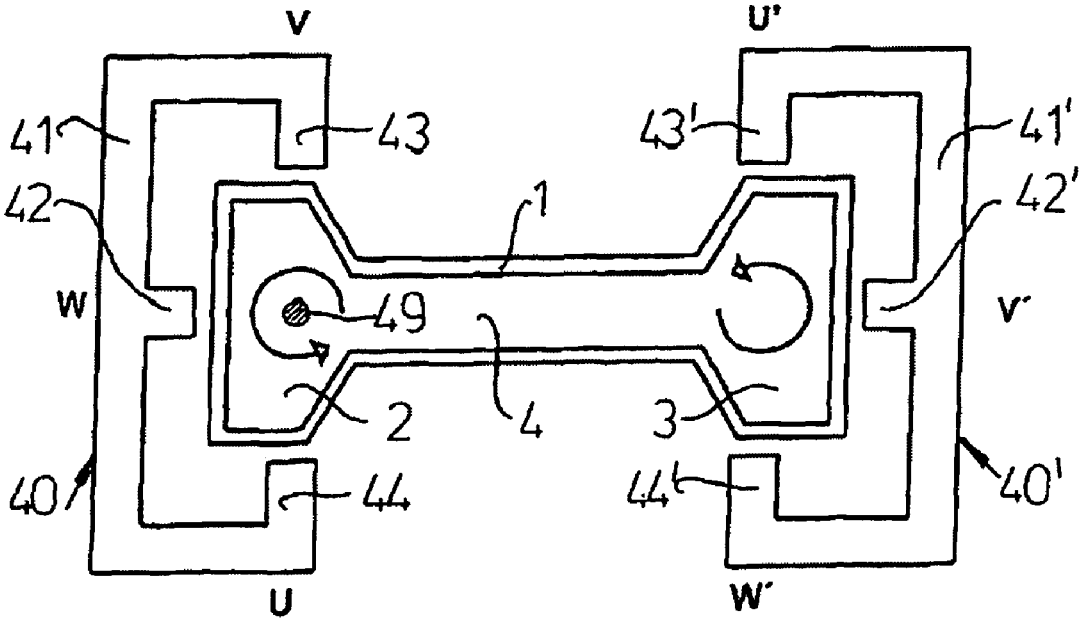

FIGS. 7 and 8 show a variant in which two electromagnetic stirrers 40, 40' or two yokes 41, 41', separated from one another in the width direction of the mold 1, with three respective pole shoes 42, 43, 44; 42', 43', 44' are associated with the mold 1 at its circumference, each yoke 41, 41' being provided with a central pole shoe 42, 42' oriented frontally towards the respective pole part 2, 3 and two pole shoes 43, 44; 43', 44' directed towards the flange part 2, 3 from both sides. By means of the two stirrers 40, 40', a 2×3-pole rotating operation can again be brought about or rotating fields which again have the same direction of rotation (FIG. 7) or opposite directions of rotation (FIG. 8) can be generated in the flange regions 2, 3. Reference 48 indicates a symmetrical ingate, while Reference 49 indicates an asymmetrical ingate.

Figure 9:
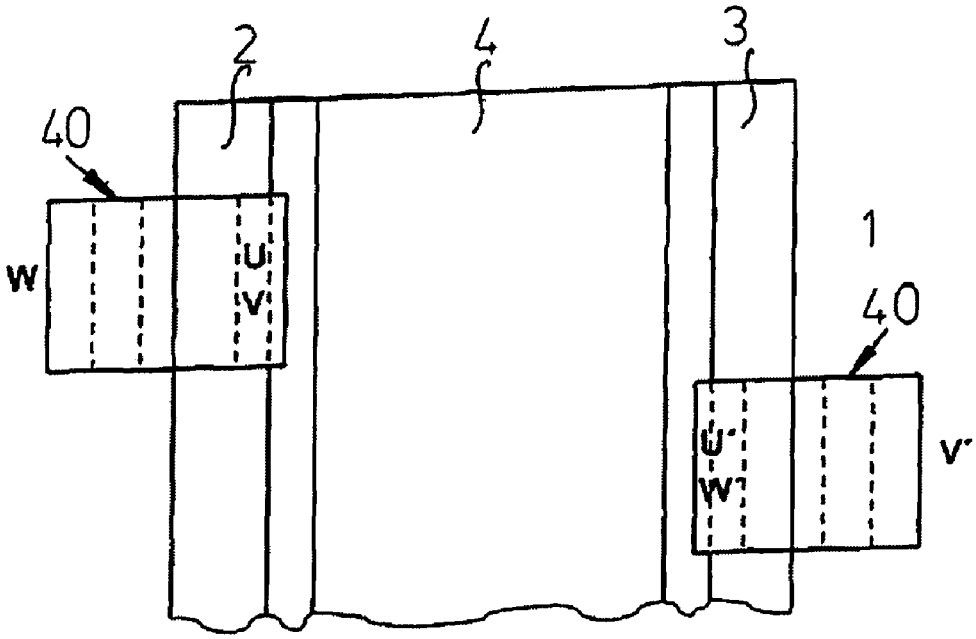
FIG. 9 shows a side view of a mold in accordance with yet additional embodiments of the invention.

Practically the same effect can be achieved with the two stirrers 40, 40' or yokes 41, 41', separated from one another in the width direction of the mold 1, as with the stirrer 30 provided with the closed yoke 31 and connected, for example, according to FIG. 5 or 6. However the former solution affords additional advantages. Electromagnetic stirrers can be constructed with two independent stirrers or half-stirrers that can be brought up to/mounted on the mold 1 relatively easily from outside. Scope for the designer is acquired through the free sector. Not least, this solution also allows the two stirrers 40, 40' to be disposed in a vertically staggered manner, as shown, for example, in FIG. 9, in which case the vertical position of the stirrers 40, 40' with respect to one another and/or related to the mold height can preferably be adjusted according to requirements.

Figure 10:
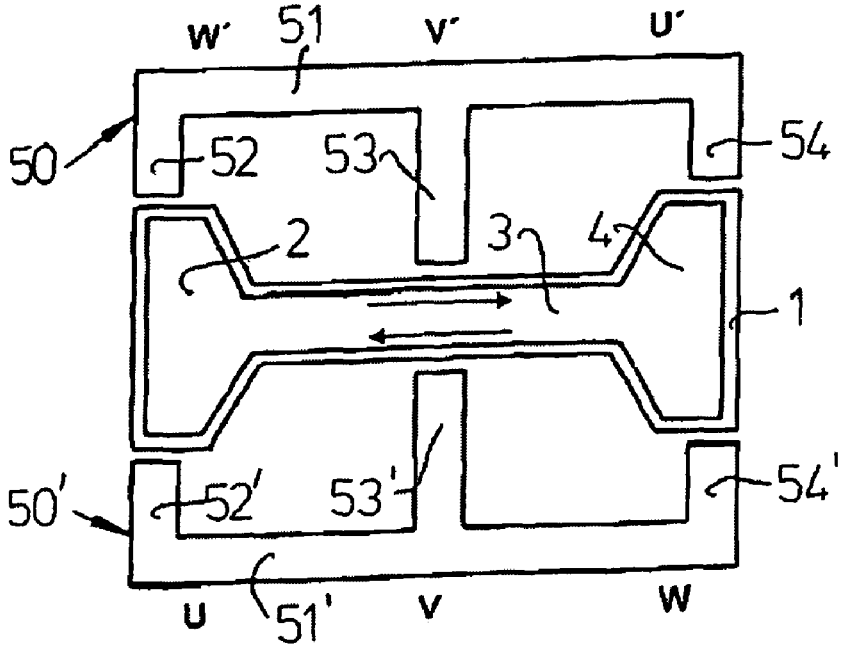
FIG. 10 shows a cross section of a mold in accordance with yet further embodiments of the invention.
Figure 11:
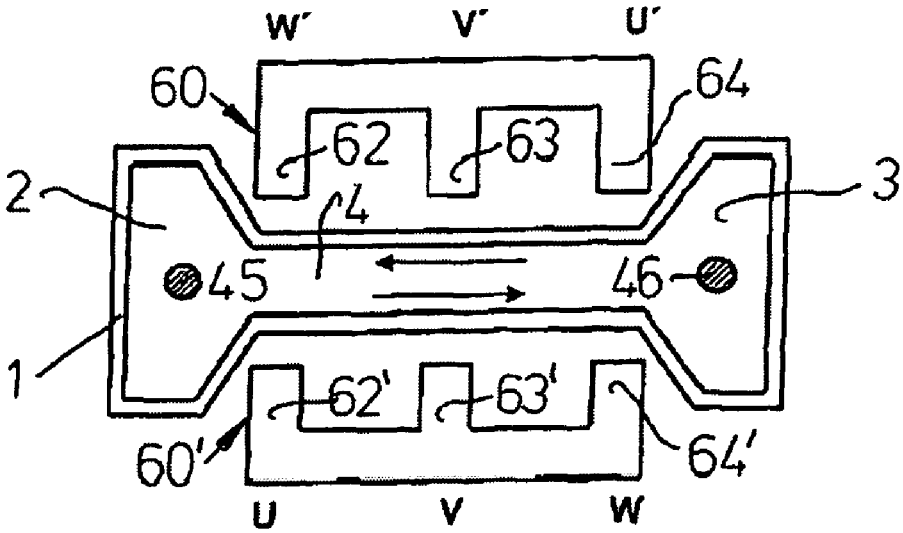
FIGS. 11-12 shows a cross section of a mold in accordance with yet more embodiments of the invention with different pole shoe connections.
Figure 12:
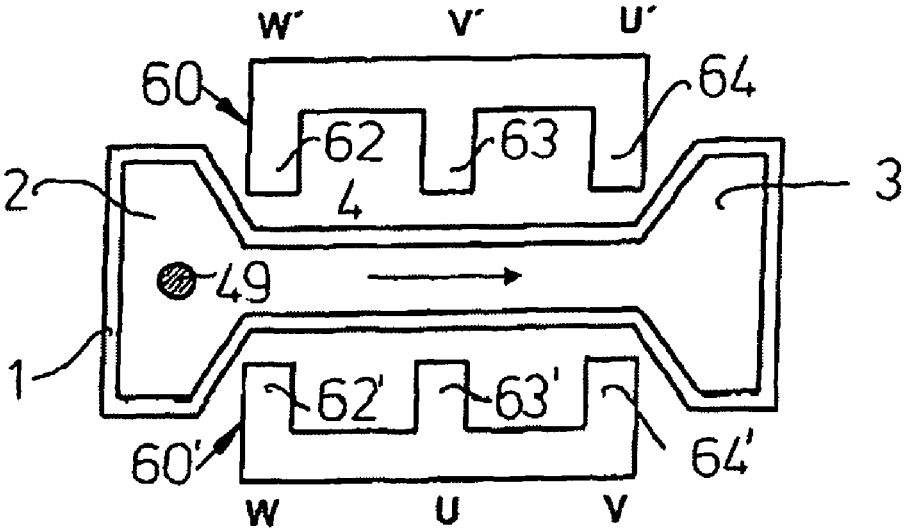
Figure 13:
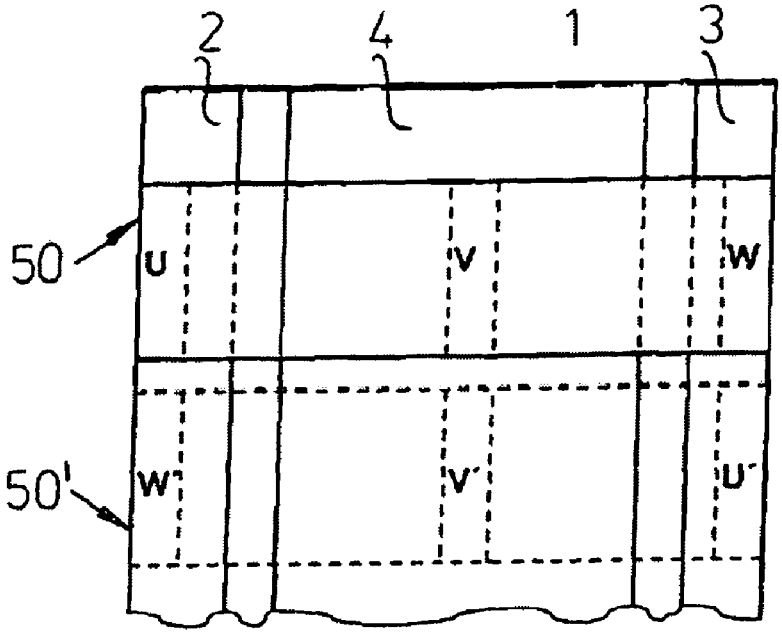
FIG. 13 shows a side view of the mold shown in FIG. 10 in according with embodiments of the invention.

Similar characteristics are provided by embodiments shown in FIGS. 10 to 12, in which two electromagnetic stirrers 50, 50' (FIGS. 10 and 13) or 60, 60' (FIGS. 11 and 12) are again associated with the mold 1 at its circumference, although these stirrers comprise yokes 51, 51' separated from one another in the thick direction of the mold 1 rather than in the width direction thereof in other embodiments such as shown in FIGS. 7 and 8. Each yoke is in each case provided with three pole shoes 52, 53, 54; 52', 53', 54' or 62, 63, 64; 62', 63', 64'.

In the embodiment according to FIG. 10 the three pole shoes 52, 53, 54; 52', 53', 54' are in each case distributed over the entire width of the preliminary section and two of them (pole shoes 52, 54; 52', 54') are directed at the sides towards the flange parts 2, 3, and the central pole shoe 53, 53' projects up to the web part 4.

In the embodiment according to FIGS. 11 and 12 all three pole shoes 62, 63, 64; 62', 63', 64' of the respective stirrer 60, 60' are only distributed over the web and project towards the web part 4. Two symmetrical ingates are represented by 45, 46.

The stirrers 50, 50' and 60, 60', respectively, are operated as linear stirrers, in the same manner as described above, in which case flows in opposite directions (FIGS. 10 and 11) or a flow in the same direction (FIG. 12) can be produced in the web part 4. The setting takes place in accordance with the casting and/or product parameters.

Figure 14:
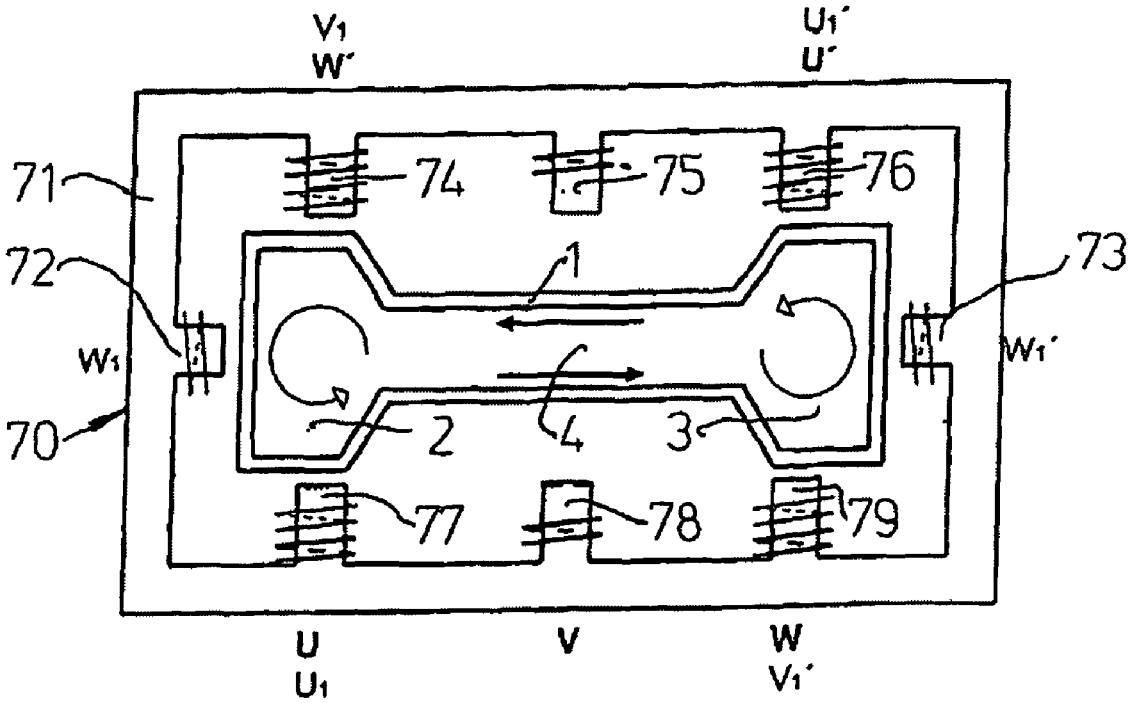
FIG. 14 shows a cross section of a mold in accordance with even further embodiments of the invention.

Finally, FIG. 14 shows an electromagnetic stirrer 70 with an 8-pole structure, composed in a similar way to the stirrer 30 according to FIGS. 3 to 6 (with a yoke 71 which is formed as a rectangular frame, with the longitudinal sides of which three respective pole shoes 74, 75, 76; 77, 78, 79, distributed over the mold width, are associated, and the narrow sides of which are provided with a respective central pole shoe 72, 73 oriented frontally towards the flange parts 2, 3). However in these embodiments, rather than either a rotating or linear operation being created by disconnecting two of the eight poles, linear fields are generated in the web part 4 using a 1×6-pole linear stirrer (pole shoes 74, 75, 76; 77, 78, 79) and rotating fields in the flange parts 2, 3 using 2×3-pole rotating stirrers (pole shoes 74, 72, 77 and 76, 73, 79) at the same time.

Figure 15:
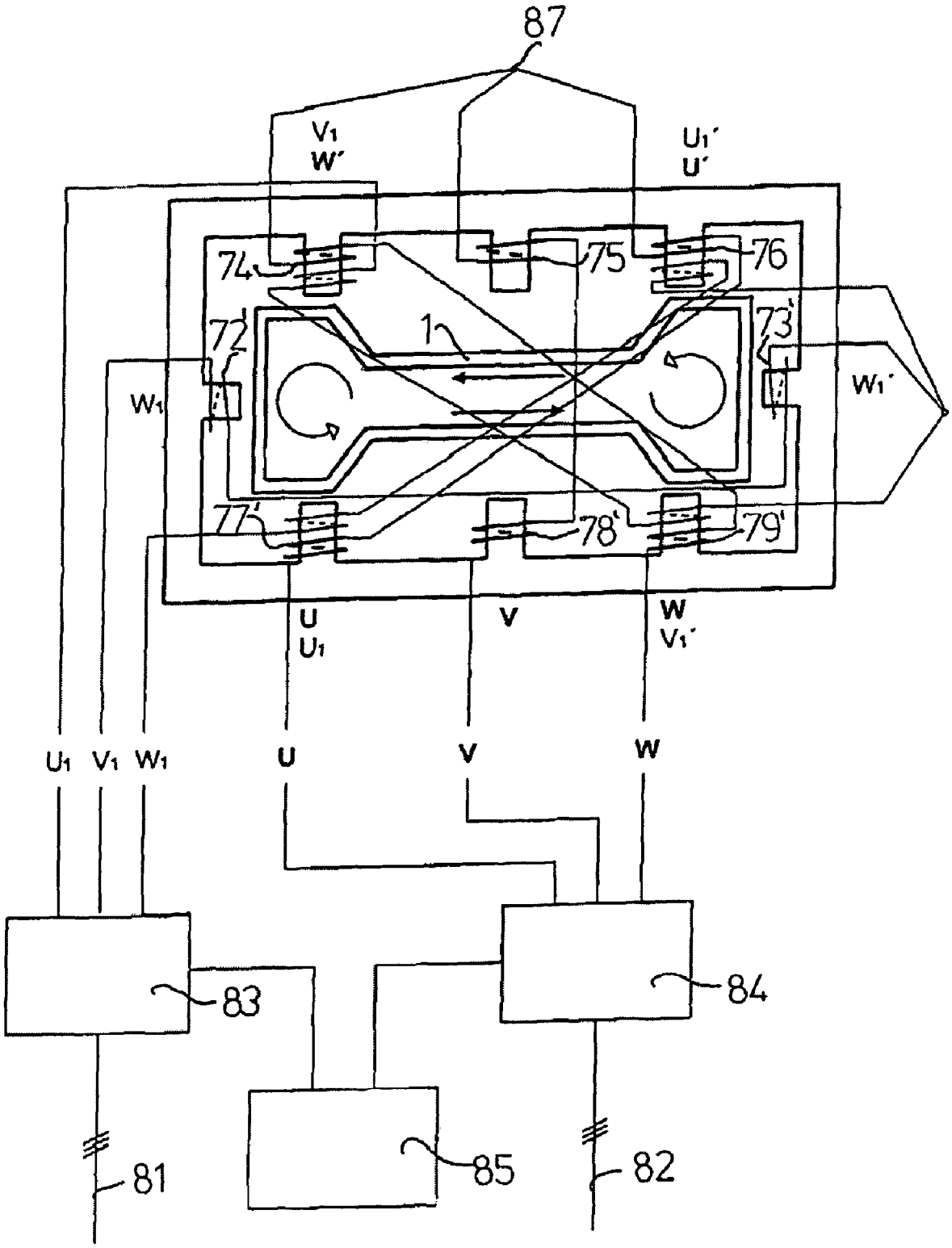
FIG. 15 shows an electrical schematic diagram in accordance with embodiments of the invention containing the mold shown in FIG. 14.

FIG. 15 shows an electrical schematic diagram of the stirrer 70 with this 8-pole structure or this 8-pole system, in which the linear fields are generated by means of a 1×6-pole linear stirrer and the rotating fields using these 2×3-pole rotating stirrers at the same time. This electromagnetic stirrer 70 is fed from the network, for example with three-phase current 50 Hz, by means of lines 81, 82, these lines 81, 82 in each case leading to a frequency converter 83, 84. These frequency converters 83, 84 are connected to a converter control 85, and the individual phases are set by this to a desired predetermined frequency.

The function of the control 85 is to tune the frequencies of the two converters to one another to synchronize the stirring movements which are produced in the web and in the transition region to the two flange parts. The control is also to prevent the occurrence of beat phenomena when the two stirrers are at slightly different frequencies. A beat would cause the one and the other pole to be under full load simultaneously in the course of time, which would result in a highly non-uniform network load.

The individual phases U, V, Woof the one converter 84 and the phases $U_1$, $V_1$, $W_1$ of the other converter 83 are routed from these frequency converters 83, 84 to the coils that are wound around the pole shoes 74, 75, 76; 77, 78, 79. The phases U, V, W lead to the coils 77', 78', 79' at the pole shoes 77, 78, 79 in the web part and further to the coils 76', 75', 74', disposed symmetrically with respect to the latter, of the pole shoes 76, 75, 74, the connecting lines being routed from the coils 77', 79' crosswise to the coils 76', 74' (connected in series). The lines are routed from these coils to the star point 87. The same applies to the phases $U_1$, $V_1$, $W_1$, although this is not illustrated in detail. In the case of the linear operation the phase $W_1$ is routed to the coil 72' and further to the opposite coil 73' and further to a star connection.

As already mentioned, it is therefore possible, by means of the electromagnetic stirrers 10; 20; 30; 40, 40'; 50, 50'; 60, 60'; 70 and using electromagnetically induced forces, in the region of the flange parts and/or of the web part to generate stirring movements in the molten core of the preliminary sectional strand transversely to the strand casting direction, and thereby exchange of the molten steel in the crater of the preliminary sectional strand between flange parts and the web part. It is as a result possible to specifically and actively influence the flow and temperature conditions in the molten steel crater within the preliminary sectional strand shell as desired and therefore produce the following effects:

- stabilization of the metal surface region by suppressing turbulence, even in the case of varying process parameters, such as, for example, casting speed and metal surface position (for the purpose of preventing non-metallic inclusions as well as gas bubbles in the strand surface);
- favorable, controllable flow conditions with a specifiable molten steel exchange between relatively thicker thickened cavity regions through a thinner web part, even in the case of an asymmetrical ingate, and thereby the formation of a uniformly thick strand shell with a favorable solidification structure, while preventing shrink holes and/or core porosity.
- prevention of arching during solidification in spite of confined conditions in the web part of the mold cavity cross section.

As a result of the choice of interconnection of the poles with the individual phases of the 3-phase current, it is possible, without making any structural changes to the stirrer, to produce different direction components and thereby different flows in the molten crater of the preliminary sectional strand in accordance with the casting parameters, such as the ingate system with regard to the number of ingates, open or closed pouring, casting speed, casting temperature, steel composition, etc. However it is also possible to use the same stirring device for molds with different product parameters, such as preliminary section dimensions, etc. and at the same time vary the pole interconnection such that rotating traveling fields can be generated in the flange part and/or linear traveling fields generated in the web part in accordance with the product parameters in order to specifically obtain flows in the molten crater.

It is noted that tubular molds are represented schematically in the figures. However, instead of tubular molds, it is also possible to operate all mold constructions which are suitable for preliminary sections, such as ingot molds or plate molds, etc., as known in the art, with the method according to the invention or to use these with the device according to the invention.

Those skilled in the art will recognize that the materials and methods of the present invention will have various other uses in addition to the above described embodiments. They will appreciate that the foregoing specification and accompanying drawings are set forth by way of illustration and not limitation of the invention. It will further be appreciated that various modifications and changes may be made therein without departing from the spirit and scope of the present invention, which is to be limited solely by the scope of the appended claims.

What is claimed is:

1. Method for continuous casting of preliminary steel sections having an I-shaped cross-section, the method comprising:

providing a continuous mold comprising a mold cavity having a generally vertical strand traveling direction and a cross section composed of at least a web part and two flange parts;

providing a stirring device consisting of one yoke, the yoke including a plurality of pole shoes situated on an inner side of the yoke and electromagnetic stirrer coils arranged in connection with the pole shoes to thereby provide a distribution of magnetic poles around the mold;

wherein the yoke is a single closed yoke that surrounds the mold, the yoke has a rectangular frame with larger sides and smaller sides and eight pole shoes, three of the pole shoes being arranged on each of the larger sides of the rectangular frame in an arrangement in which a respective one of the three pole shoes faces each of the flange parts and one of the pole shoes faces the web part, and one of the pole shoes being arranged in a center area on each of the smaller sides of the rectangular frame facing a respective one of the flange parts, introducing molten steel substantially vertically into the mold cavity so as to form a partly solidified preliminary sectional strand having a molten crater therein;

interconnecting said poles and providing said interconnected poles with 3-phase alternating current to form one of a plurality of different electromagnetic traveling fields in the molten crater having direction components transverse to the strand traveling direction and cause, as a result of the formation of the electromagnetic travelling field, the molten steel in the molten crater of the strand to flow from one portion of the strand to another, the different electromagnetic travelling fields including a linearly oriented electromagnetic field that causes molten steel in the molten crater of the strand to flow through the web part in a direction from one flange part toward the other flange part and a rotational electromagnetic field that causes molten steel in the molten crater of the strand to flow around one or both of the flange parts;

the steps of interconnecting the poles and providing the poles with 3-phase alternating current comprising interconnecting all of the poles except for the poles on the smaller sides of the rectangular frame to cause linear flow of the molten steel in the molten crater of the strand through the web part in the direction from one flange part toward the other flange part or interconnecting all of the poles except for the poles facing the web part to cause rotational flow of the molten steel in the molten crater of the strand in each of the flange parts; and selecting the arrangement of the plurality of arrangements to interconnect said poles with the individual phase of the 3-phase current in accordance with casting parameters.

2. Method according to claim 1, wherein the at least one stirring device is vertically positionally adjustable.

3. Method according to claim 1, wherein the step of providing the stirring device includes selecting a distribution of magnetic poles based upon at least one of a dimension of the preliminary steel section, a thickness of the web part, steel quality, the number of ingates, and whether the molten steel is introduced into the mold symmetrically or asymmetrically.

4. Method according to claim 1, wherein the steps of interconnecting said poles and providing said poles with 3-phase alternating current are performed so that the flow of molten steel in the molten crater has at least one of rotational direction components in one flange part and linear direction components in the web part.

5. Method according to claim 4, wherein the rotational direction components of the flow in one of the flange parts is one of a same direction and an opposite direction as the rotational direction components of the flow in the other flange part.

6. Method according to claim 1, wherein the steps of interconnecting said poles and providing said poles with 3-phase alternating current are performed so that the electromagnetic traveling fields formed in each of the flange parts have rotational direction components that are one of the same direction and an opposite direction relative to each other.

7. Method according to claim 6, wherein the electromagnetic traveling fields are formed in transition regions from the web part to the two flange parts.

8. Method according to claim 1, wherein the steps of interconnecting said poles and providing said poles with 3-phase alternating current are performed so that the electromagnetic traveling fields formed in the web part have linear direction components that are one of a same direction or opposite directions.

9. Method according to claim 4, wherein the molten steel is introduced via a symmetrically disposed ingate in the web part, and the steps of interconnecting said poles and providing said poles with 3-phase alternating current are performed so that the flow of molten steel in the molten crater has rotational direction components in at least one of the flange parts.

10. Method according to claim 4, wherein the molten steel is introduced via an asymmetrically disposed ingate in one of the flange parts, and the steps of interconnecting said poles and providing said poles with 3-phase alternating current are performed so that the flow of molten steel in the molten crater has linear direction components in the web part.

11. Method according to claim 1, further comprising providing a strand guide with secondary cooling devices; and feeding the partly solidified preliminary sectional strand from the mold to the strand guide.

12. Method according to claim 1, further comprising:

coupling said poles to a source of the 3-phase current; and controlling the flow of the individual phases of the 3-phase current from the source to said poles in accordance with the arrangement in which said poles are interconnected with the individual phases of the 3-phase current.

13. Method according to claim 1, further comprising arranging said poles to enable said poles to be interconnected with the individual phases of the 3-phase current in all of the plurality of different arrangements without making structural changes to the at least one stirring device.

14. Method according to claim 1, wherein the step of selecting the arrangement of the plurality of arrangements to interconnect said poles with the individual phases of the 3-phase current in accordance with casting parameters comprises selecting the arrangement based on a number of ingates.

15. Method according to claim 1, wherein the step of selecting the arrangement of the plurality of arrangements to interconnect said poles with the individual phases of the 3-phase current in accordance with casting parameters comprises selecting the arrangement based on whether the pouring of the molten steel is an open or closed pouring.

16. Method according to claim 1, wherein the step of selecting the arrangement of the plurality of arrangements to interconnect said poles with the individual phases of the 3-phase current in accordance with casting parameters comprises selecting the arrangement based on a casting speed.

17. Method according to claim 1, wherein the step of selecting the arrangement of the plurality of arrangements to interconnect said poles with the individual phases of the 3-phase current in accordance with casting parameters comprises selecting the arrangement based on a casting temperature.

18. Method according to claim 1, wherein the step of selecting the arrangement of the plurality of arrangements to interconnect said poles with the individual phases of the 3-phase current in accordance with casting parameters comprises selecting the arrangement based on a composition of the molten steel.

* * * * *